United States Patent [19]

Oguchi et al.

[11] 4,154,603

[45] May 15, 1979

[54] METHOD OF PRODUCING ALLOY STEELS HAVING AN EXTREMELY LOW CARBON CONTENT

[75] Inventors: Yukio Oguchi; Shuya Yano; Akio Ejima, all of Chiba; Hiroyuki Kaito, Takarazuka; Takashi Ohtani; Shoji Iwaoka, both of Ashiya, all of Japan

[73] Assignee: Kawasaki Steel Corporation, Kobe, Japan

[21] Appl. No.: 873,002

[22] Filed: Jan. 27, 1978

[30] Foreign Application Priority Data

Jan. 31, 1977 [JP] Japan ..... 52-8715

[51] Int. Cl.[2] ..... C21C 7/10

[52] U.S. Cl. ..... 75/49; 75/60

[58] Field of Search ..... 75/49, 60

[56] References Cited

U.S. PATENT DOCUMENTS

| | | | |
|---|---|---|---|
| 3,802,865 | 4/1974 | Ohkubo | 75/53 |
| 3,925,061 | 12/1975 | Carlsson | 75/49 |
| 3,980,469 | 9/1976 | Forster | 75/49 |
| 4,054,445 | 10/1977 | Ramacciotti | 75/53 |

*Primary Examiner*—P. D. Rosenberg

[57] ABSTRACT

A method of producing alloy steels having an extremely low carbon content of not higher than 30 ppm is disclosed. The alloy steels can be obtained by vacuum treating a preliminarily decarburized molten steel in the presence of a proper amount of a slag containing specifically limited amounts of chromic oxide and silicon oxide under an inert gas atmosphere by means of a commonly used degassing apparatus.

4 Claims, 4 Drawing Figures

METHOD OF PRODUCING ALLOY STEELS HAVING AN EXTREMELY LOW CARBON CONTENT

BACKGROUND OF THE INVENTION (1) Field of the Invention

The present invention relates to a method of producing alloy steels having an extremely low carbon content, and more particularly relates to a method of producing such high grade alloy steels having an extremely low carbon content inexpensively by promoting the decarburization reaction for alloy steel having a low carbon content with the use of a commonly used vacuum degassing apparatus without recourse to a special method.

(2) Description of the Prior Art

Steels having a very low carbon content are generally produced from molten steel by the vacuum degassing process which utilizes CO gas generated from the molten steel. As the vacuum degassing process, the RH circulating degassing process and VOD ladle degassing process have already been used in industry. However, in these vacuum degassing processes, CO gas pressure, which equilibrates with carbon and oxygen present in a molten steel having a very low carbon content, is close to the operation pressure of the vacuum apparatus, and CO bubbles are difficult to be generated, and hence the decarburization rate of the steel is very low. Therefore, it is considered that, when the carbon content of a molten steel is lower than a certain critical value, the decarburization of the steel no longer proceeds.

Moreover, when a molten steel containing chromium is decarburized, the following problems occur.

(1) The presence of chromium lowers the activities of carbon and oxygen in the molten steel, and hence the potential for forming CO gas of the steel is low.

(2) When it is intended to decrease the carbon content of the molten steel by increasing the oxygen content thereof based on equilibrium of carbon, oxygen and CO, chromium is always oxidized.

Therefore, it is very difficult to produce high-chrome steel having a very low carbon content.

In order to obviate these drawbacks, a stainless steel having an extremely low carbon content is commonly produced from a starting steel having an extremely low carbon content by a vacuum melting process or by an electron beam melting process. However, in both of these processes, the cost of the starting steel and the melting cost of the steel are very high, and mass production of the aimed stainless steel having an extremely low carbon content is impossible.

SUMMARY OF THE INVENTION

The object of the present invention is to provide a method capable of producing alloy steels having an extremely low carbon content ($C \leqq 30$ ppm) in a relatively simple manner by the use of a commonly used degassing apparatus for molten steel. The inventors have investigated minutely the drawbacks in the conventional technics and found out that "the critical value of the carbon content of a molten steel relating to the decarburization rate of the steel" is merely a false phenomenon due to the decreasing of decarburization rate. That is, the inventors have ensured that, when a decarburization reaction is promoted even in a low carbon range by the means to be explained later, the carbon content in a steel can be decreased to an extremely low amount, which is close to the theoretical equilibrium value, and accomplished the present invention.

The feature of the present invention lies in a method of producing alloy steels having an extremely low carbon content from a preliminarily decarburized molten steel containing 10–35% of chromium, comprising subjecting said molten steel to a vacuum decarburization treatment under a non-killing state in a ladle, while contacting the molten steel with 1–100 kg of a slag per 1 ton of the molten steel, said slag consisting of not more than 25% of $Cr_2O_3$, not less than 20% of $SiO_2$ and the remainder of an incidental slag oxide, and at the same time stirring the molten steel by flowing an inert gas thereinto at a rate of 6–40 Nl/min per 1 ton of the molten steel from the bottom of the ladle.

DETAILED DESCRIPTION OF THE INVENTION

The present invention will be explained in more detail referring to the accompanying drawings.

Figure 1:
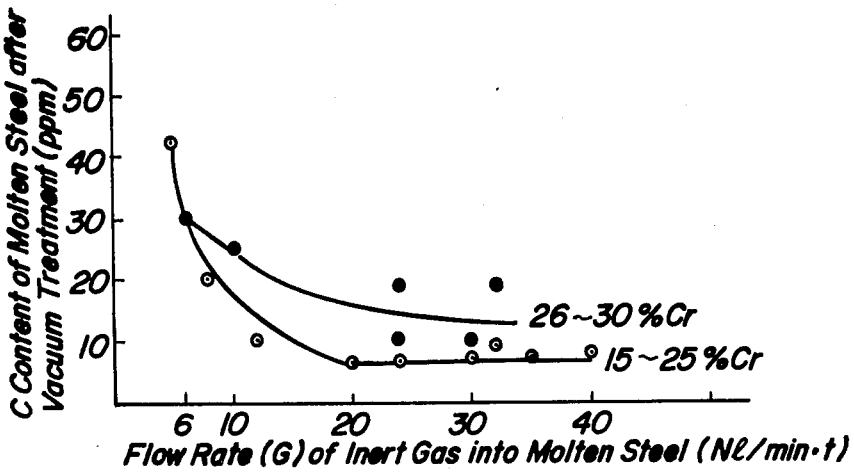
FIG. 1 is a graph showing a relation between the flow rate of an inert gas into a molten steel in a vacuum decarburization treatment and the carbon content of the molten steel after the vacuum treatment.

FIG. 1 shows a relation between the flow rate (G) of an inert gas into a chrome steel in a vacuum decarburization treatment by means of a vacuum degassing apparatus and the carbon content of the vacuum-treated steel. It can be seen from FIG. 1 that, when the flow rate (G) is sufficiently high, the carbon content of the vacuum-treated steel is low. However, when the flow rate (G) is less than 6 Nl/min·t, the decarburization rate is low and the carbon content of the treated steel is high. Therefore, the flow rate (G) of an inert gas must be not less than 6 Nl/min·t in order to produce an alloy steel having an extremely low carbon content of not more than 30 ppm.

Further, it can be seen from FIG. 1 that a higher flow rate (G) is more effective for decarburization. However, excessively high flow rate is not so effective. When a molten steel is violently bubbled due to excessively high blow rate, the molten steel is flowed out from a ladle, and the refractories used in the ladle is seriously damaged, and further a large amount of porous bricks (used in the blowing nozzle) are consumed. Of course, the upper limit of the flow rate (G) of an inert gas is so determined that these unfavorable phenomena do not occur. It has been found from experiments in the present invention that the upper limit is 40 Nl/min·t. This value varies more or less depending upon the capacity of the ladle.

The inventors have further carried out the following experiment in order to decrease the carbon content of a steel. Oxygen gas is top blown into a molten steel having a carbon content of not more than 0.03% in order to contain an excess amount of oxygen in the steel and to promote the generation of CO bubbles. However, in this experiment, the carbon content in the vacuum-treated steel was not decreased, but increased. The inventors have studied minutely this phenomenon and found out that the increase of the amount of oxygen does not serve to remove carbon but increases noticeably the amount of $Cr_2O_3$ in a slag, and the $Cr_2O_3$ affects adversely the decarburization.

Figure 2:
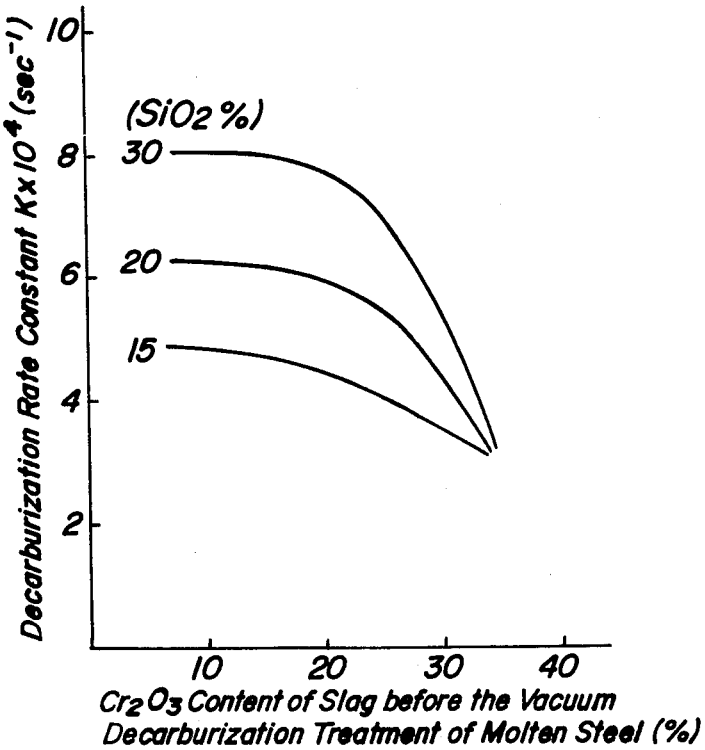
FIG. 2 is a graph showing the influence of the composition of a slag used together with a molten steel in the treatment upon the decarburization rate constant of the steel.

The inventors have found out an unexpected phenomenon from the above discovery that the composition of a slag to be used together with a steel, particularly the amounts of $Cr_2O_3$ and $SiO_2$ contained in the slag have a high influence upon the decarburization reaction of the steel. FIG. 2 shows an influence of the composition of a slag used together with a steel in the vacuum decarburization treatment thereof upon the decarburization rate constant of the steel. As seen from FIG. 2, when the $Cr_2O_3$ content of the slag before the vacuum decarburization treatment of a steel exceeds 25%, the decarburization rate constant of the steel:K-$(sec^{-1}) = -d\ln[\%C]/dt$:decreases noticeably and therefore the $Cr_2O_3$ content of a slag before the vacuum decarburization treatment of a steel must be kept as low as possible in order to obtain an alloy steel having an extremely low carbon content.

Further, it can be seen from FIG. 2 that, unless the $SiO_2$ content of a slag used together with a steel is not less than 20% before the decarburization of a steel, the decarburization rate of the steel is not satisfactorily high. The reason why $SiO_2$ promotes the decarburization reaction of a steel is not clear, but is that a part of $SiO_2$ is probably reduced during the vacuum decarburization treatment of a steel to supply oxygen necessary for the decarburization of the steel. Therefore, in the present invention, the $SiO_2$ content of a slag before the vacuum decarburization treatment of a steel is adjusted in the following manners.

(a) The amount of $SiO_2$ to be formed by the oxidation of Si present in a steel during the preliminary decarburization treatment of the steel is controlled.

(b) $SiO_2$ is additionally added to a slag formed during the preliminary decarburization treatment of a steel.

(c) At least a part of a slag formed during the preliminary decarburization treatment of a steel is removed and a flux having a proper $SiO_2$ content is added to the steel.

Among the above described procedures, the procedure (a) is disadvantageous, because the silicon content of a steel or the amount of oxygen to be supplied to the steel in the preliminary decarburization treatment must be strictly controlled. However, the procedures (b) and (c) can be easily carried out, because it is not necessary to control so strictly these conditions.

When the $Cr_2O_3$ and $SiO_2$ contents of a slag are within the above defined range, slag oxides, such as MgO, CaO, $Al_2O_3$ and the like, other than $Cr_2O_3$ and $SiO_2$ have no influence upon the decarburization rate of a steel, and it is not necessary to limit the contents of these oxides in the slag.

Figure 3:
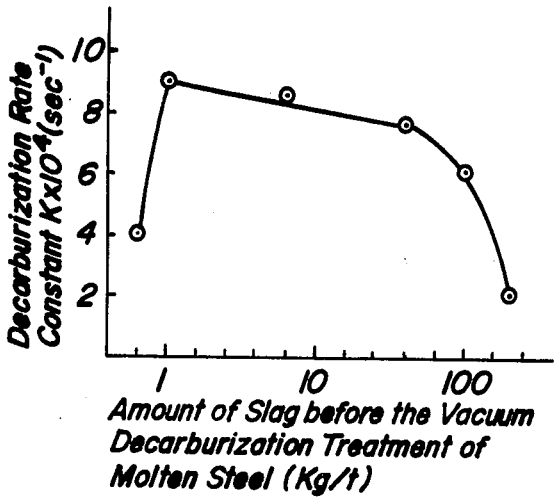
FIG. 3 is a graph showing a relation between the amount of a slag used together with a molten steel in the treatment and the decarburization rate constant of the steel.

FIG. 3 shows a relation between the amount of a slag used together with a steel in a vacuum decarburization treatment thereof and the decarburization rate of the steel. It can be seen from FIG. 3 that an excess amount of slag is not preferable. Even when the slag has a proper composition, if the slag is used in an amount of more than 100 kg per 1 ton of a molten steel, the steel is difficult to be decarburized. While, even when a vacuum decarburization reaction of a steel is carried out in the absence of slag, the decarburization rate of the steel is not always high. This is probably based on the reason that, after the slag is removed, another slag is generated due to the oxidation of a molten steel or due to the refractories, and moreover the newly generated slag has not a proper composition.

Figure 4:
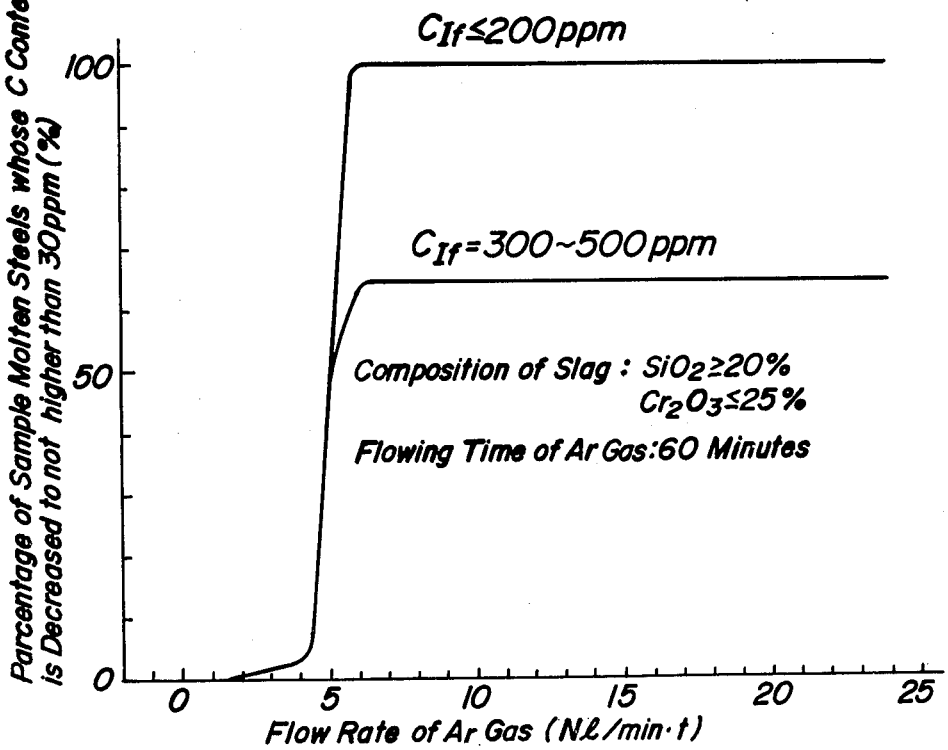
FIG. 4 is a graph showing a relation between the flow rate of an inert gas into sample molten steels in the treatment and the percentage of numbers of the sample steels, whose carbon content is decreased to not higher than 30 ppm.

FIG. 4 shows a relation between the flow rate of Ar gas into sample steels having a carbon content of not higher than 200 ppm or sample steels having a carbon content of 300–500 ppm in a vacuum decarburization treatment and the percentage of numbers of the sample steels, whose carbon content is decreased to not higher than 30 ppm by the treatment. In FIG. 4, the term "$C_{If}$" means the carbon content of the preliminarily decarburized molten steel, that is, the carbon content in a molten steel before the vacuum decarburization treatment of the present invention.

It can be seen from FIG. 4 that, unless a preliminarily decarburized molten steel having a carbon content of not higher than 200 ppm is used, it is difficult to produce a steel having a carbon content of not higher than 30 ppm.

Further, in the present invention, the molten steel to be subjected to the vacuum decarburization treatment is preferred to be previously kept at a temperature of not lower than 1,700° C. in order to prevent the loss of chromium.

The following examples are given for the purpose of illustration of this invention and are not intended as limitations thereof.

In all the examples, a steel was previously subjected to the following preliminary vacuum decarburization treatment (hereinafter this treatment is merely referred to as preliminary treatment), and the preliminarily decarburized steel was subjected to the vacuum decarburization treatment of the present invention. In the preliminary treatment, a crude steel containing 17% or 26% of chromium was melted in an electric furnace of 50 ton capacity, and after the resulting slag was removed, the resulting molten steel was charged into a ladle. After the ladle was placed in a VOD vacuum tank, the molten steel was kept at a temperature of 1,650–1,700° C. and then subjected to a preliminary treatment until the carbon content was decreased to not higher than 0.02% under a reduced pressure of 5–60 Torrs, while top blowing oxygen gas to the surface of the molten steel and at the same time fottom blowing Ar gas to to the steel.

The above preliminarily decarburized molten steel was subjected to the vacuum decarburization treatment of the present invention, wherein Ar gas was flowed into the ladle from the bottom of the ladle under vacuum in the presence of a proper amount of slag.

The treating condition in the vacuum decarburization treatment and the obtained results are shown in the following Table 1.

Table 1

| | Example | | | Comparative Example | |
|---|---|---|---|---|---|
| | 1 | 2 | 3 | 1 | 2 |
| Preliminary decarburization treatment | VOD process, oxygen is top blown | | | VOD process, oxygen is top blown | |
| Vacuum decarburization treatment | | | | | |
| C content of molten steel before treatment (%) | 0.018 | 0.010 | 0.016 | 0.009 | 0.010 |
| Temperature of molten steel before treatment (° C.) | 1,700 | 1,700 | 1,720 | 1,710 | 1,700 |
| Flow rate of inert gas (Nl/min.t) | 8 | 20 | 30 | 25 | 35 |
| Slag Amount (kg/t) | 60 | 70 | 10 | 60 | 70 |
| $SiO_2$ (%) | 30 | 25 | 35 | 18 | 25 |
| $Cr_2O_3$ (%) | 20 | 20 | 10 | 30 | 30 |
| Slag formation | Oxygen blowing | Addition of 4 kg of $SiO_2$ per 1 ton of molten steel | Synthetic slag | Oxygen blowing | Addition of 4 kg of $SiO_2$ per 1 ton of molten steel |
| Treating time (min) | 60 | 60 | 60 | 60 | 60 |
| C content of molten steel after treatment (ppm) | 20 | 7 | 10 | 55 | 35 |
| Cr content of starting steel (%) | 17 | 17 | 26 | 18 | 17 |
| Vacuum degree in the treatment (Torr) | 0.1 to 0.5 | 0.1 to 0.5 | 0.1 to 0.5 | 0.1 to 0.5 | 0.1 to 0.5 |
| Temperature of molten steel at the end of treatment (° C.) | 1,610 | 1,600 | 1,620 | 1,610 | 1,610 |

EXAMPLE 1

The preliminary treatment was effected, while supplying oxygen gas into the ladle so as to form a slag containing 20% of $Cr_2O_3$ and 30% of $SiO_2$. Successively, the preliminarily decarburized molten steel was subjected to a vacuum decarburization treatment together with the slag. As the result, the carbon content of the vacuum-treated steel was as low as 20 ppm.

EXAMPLE 2

It has been found that the amount of $SiO_2$ contained in the slag itself formed by the preliminary treatment is somewhat short. Therefore, 4 kg of $SiO_2$ per 1 ton of the preliminarily decarburized molten steel was added to the slag so that the resulting slag contained 25% of $SiO_2$. As the result, the carbon content of the vacuum-treated steel was as low as 7 ppm.

EXAMPLE 3

A 26% Cr steel was subjected to a preliminary treatment, and the slag formed in the treatment was removed. Then, 10 kg of a synthetic slag consisting of 35% of $SiO_2$, 10% of $Cr_2O_3$ and the remainder being composed of MgO, CaO and $Al_2O_3$ was added to every one ton of the preliminarily decarburized molten steel, and the mass was immediately subjected to a vacuum decarburization treatment. As the result, the carbon content of the vacuum-treated steel was as low as 10 ppm.

COMPARATIVE EXAMPLE 1

In the preliminary treatment, a sufficiently large amount of oxygen was supplied into the ladle to promote the decarburization of the steel and to obtain a preliminarily decarburized molten steel having a carbon content of as low as 0.010%. However, the resulting slag contained 30% of $Cr_2O_3$ and less than 20% of $SiO_2$. The preliminarily decarburized molten steel was subjected to a vacuum decarburization treatment together with the slag as such. As the result, the carbon content of the vacuum-treated steel was as high as 55 ppm.

COMPARATIVE EXAMPLE 2

4 kg of $SiO_2$ per 1 ton of the preliminarily decarburized molten steel was added to the slag before the vacuum decarburization treatment of the steel so that the resulting slag contained 25% of $SiO_2$. However, since the slag contained 30% of $Cr_2O_3$, the carbon content of the vacuum-treated steel was as high as 35 ppm.

The method of the present invention can be applied to any kinds of steels other than high-chrome steel. For example, ordinary steel can be very effectively decarburized in a very short period of time. Further, when the method of the present invention is combined with a denitrification step, desulfurization step or deoxidation step, a high purity steel containing very small amounts of carbon, nitrogen, sulfur, oxygen and the like can be obtained.

What is claimed is:

1. A method of producing alloy steels having a carbon content of not higher than 0.0030%, comprising subjecting a molten steel containing 10–35% Cr to a preliminary decarburization treatment until the carbon content in the steel is decreased to not more than 0.020% in a vacuum degassing equipment or the like, while blowing oxygen into the molten steel or contacting the molten steel with another oxygen source, subjecting the preliminary decarburized molten steel to a vacuum decarburization treatment under a non-killing state in a ladle placed in a vacuum tank, simultaneously stirring the molten steel by flowing an inert gas thereinto from the bottom of the laddle at a rate of 6–40 Nl/min per 1 ton of the molten steel, while contacting the molten steel with 1–100 Kg of a slag per 1 ton of the molten steel without blowing oxygen, the slag consisting of not more than 25% of $Cr_2O_3$ and not less than 20% of $SiO_2$, and the remainder being incidental slag oxide.

2. A method according to claim 1, wherein said incidental slag oxide is MgO, CaO, $Al_2O_3$ or a mixture thereof.

3. A method according to claim 1, wherein said preliminarily decarburized molten steel is previously heated at a temperature of not lower than 1,700° C. before the molten steel is subjected to the vacuum decarburization treatment.

4. A method according to claim 1, wherein said decarburization treatment is carried out under a vacuum of not more than 0.5 Torr.

* * * * *